US005152130A

United States Patent [19]

McGrew

[11] Patent Number: 5,152,130

[45] Date of Patent: Oct. 6, 1992

[54] LINE SPLICING MACHINE

[76] Inventor: James D. McGrew, 8120 Rio Linda Blvd., Elverta, Calif. 95626

[21] Appl. No.: 758,792

[22] Filed: Sep. 12, 1991

[51] Int. Cl.[5] ..... D01H 17/00

[52] U.S. Cl. ..... 57/23

[58] Field of Search ..... 57/23; 289/16, 17

[56] References Cited

U.S. PATENT DOCUMENTS

| | | | |
|---|---|---|---|
| D. 227,852 | 7/1973 | McGrew | D8/14 |
| 748,714 | 1/1904 | Fesenfeld | 57/23 |
| 811,788 | 2/1906 | McSpadden et al. | 57/23 |
| 1,293,453 | 2/1919 | Jacobson et al. | 57/23 |
| 1,534,926 | 4/1925 | Doble | 57/23 |
| 3,823,535 | 7/1974 | McGrew | 57/23 |
| 4,099,750 | 7/1978 | McGrew | 289/1.5 |

FOREIGN PATENT DOCUMENTS

| | | | |
|---|---|---|---|
| 225561 | 10/1909 | Fed. Rep. of Germany | 57/23 |

*Primary Examiner*—Joseph J. Hail, III

*Attorney, Agent, or Firm*—Joseph E. Gerber

[57] ABSTRACT

A line splicing machine comprised of an elongate tubular fid, a removable tip and wire snare slidably disposed within the fid are disclosed. The tip has a shank which nests in the fid's forward end, the shank having a slot for receipt of the wire snare. The wire snare is biased in a rearward direction to hold either the tip, or the end of a line to be spliced, against the fid's forward end. In one embodiment, the mechanism for biasing the wire snare rearward comprises a spring-biased, over-center flop handle. In another, the biasing mechanism is a pivoting arm having a sliding collar thereon, the collar inhibiting the arm's motion when settled against a toothed protrusion. An embodiment with interchangeable sized fids, and a fid adaptor sleeve having a conical end and a concave end for increasing the size of line able to be spliced with a given fid size, are also disclosed.

37 Claims, 8 Drawing Sheets

FIG.—5A
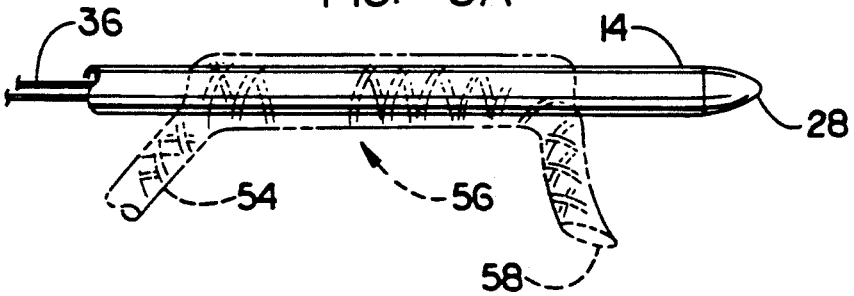
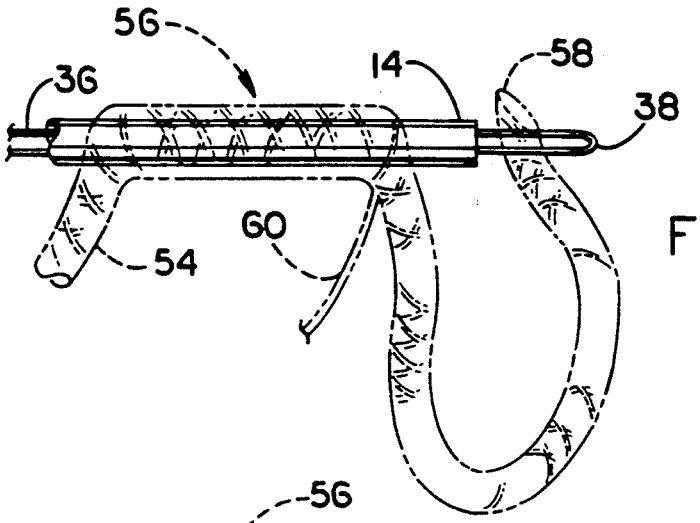
FIG.—5B
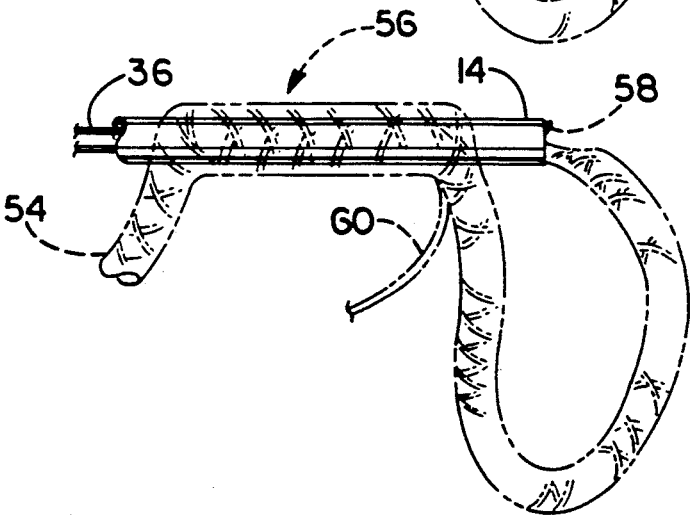
FIG. - 5C
FIG.—5D
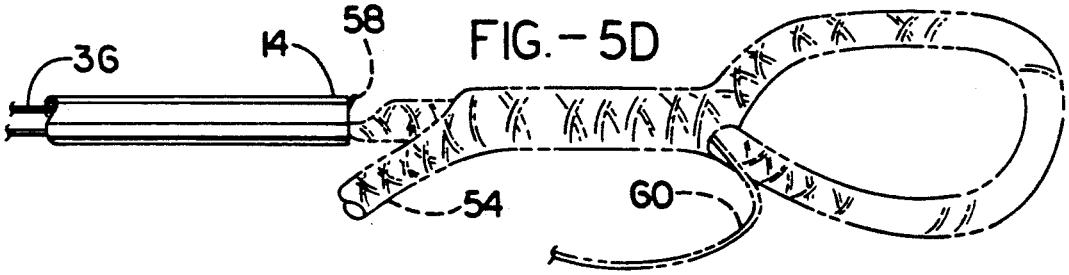

LINE SPLICING MACHINE

BACKGROUND OF THE INVENTION

1. Field Of The Invention

The present invention relates generally to line splicing tools, and more specifically to a machine for splicing laid and braided lines.

2. Description Of The Related Art

Laid and braided line is employed for a wide range of purposes in practicing many different arts. The use and manipulation of such line is, perhaps, most advanced in the nautical arts; but, such line is extensively used in ranching, in binding loads and moving cargo, in various sports such as rock climbing and in many other arts, as well. Splicing laid and braided line has always presented difficulties, thus various devices have been developed to aid in this task. Such devices generally permit one to raise a strand in the standing part of the line, thus creating a localized channel therethrough. Once unlaid, it is then an easy matter to tuck one or more strands of the line's end through the channel in performing a splice. In some cases, as when working with laid line and forming a simple transverse channel therethrough, a common fid or marlinespike may work sufficiently well to unlay the line. However, the tuck is greatly facilitated if the tool used is able to hold the channel open for easy receipt of the line's end as it is tucked through. For this purpose, a tool such as my Rope Splicing Fid disclosed in my 1973 U.S. Design Pat. No. D227,852, and in my 1974 U.S. Pat. No. 3,823,535, works satisfactorily. The tool of said patent includes a tubular handle with a removable tip; this tip is removed once the tool is forced between the lays. The handle of the tool remains in place, thereby forming a channel transverse to the axis of the line. The tuck is then easily accomplished by passing the line's end through the tool's tubular handle, and thereafter withdrawing the handle from between the lays. However, hard laid line is very difficult to work with this and other more conventional tools. And, in performing more complex splices wherein several consecutive tucks of a single strand end is required or, in working braided and double braided line wherein the splicing operation requires the formation of an axial channel in the line's standing part, it is more troublesome to create and maintain the proper channel or channels and more positive control of the line end is necessary. The rigid and flexible fids discussed in my U.S. Pat. No. 4,099,750 issued in 1978 present a partial solution to these challenges. The rigid fid therein has a rear aperture into which a taped-up line end is tucked; the fid and trailing line end are then driven through the line's standing part with a pusher to create an axial channel therein. This is a cumbersome and time-consuming operation. The flexible fid comprises a length of thin cable which is smooth and blunt on one end and which has a hook projecting from the other. This flexible fid is used by setting its hook into a knot in a line's end and by binding the device, with thread and tape, into axial relation to the line. Then, it is used to guide the end as necessary in performing a splice. Despite their utility, these fids have limitations, one being that they always have a bulky line end trailing behind them. This presents difficulty, for example, in milking the fid and trailing line end through an axial channel in braided line. And, braided line, as is used in the sheath and core of double braided line, is hollow. When bent, this hollow structure causes such line to flatten, which makes it difficult to guide such fids therethrough. And, regarding the flexible fid, once the line end has been drawn through to its final position, the end with the fid is simply severed therefrom and the splice is trimmed, as usual. However, to reuse the fid, there remains the burdensome task of detaching it from the severed line end.

In addition to dealing with the above-noted difficulties, the experienced splicer knows that splicing requires dynamic hand manipulation of the line and that it would be very advantageous to be able to use both hands in this operation instead of using one hand a great deal of the time to manipulate the splicing tool. Thus, it appears that a need exists for a splicing apparatus able to free the splicer's hands, as well as to permit the splicer to work laid line of any type efficiently, even where several tucks are necessary. It would also be beneficial if such apparatus permitted one to work braided and double braided lines, and to pass a line end easily along an axial channel therethrough, without the need to tape the line's end, nor to bind the line's end so firmly to the tool.

SUMMARY OF THE INVENTION

The line splicing machine of the present invention is adapted to overcome the above-noted shortcomings and to fulfill the stated needs. In its several embodiments, the inventive machine comprises an elongate, preferably tubular, fid having a forward end and a rearward end; a removable tip at the fid's forward end; and, means for biasing a line end against said fid's forward end. One embodiment employs a spring-biased flop handle for biasing a line end against the fid's forward end and another, for use on a bench top, employs a locking pivoting arm for that purpose. Other aspects of the invention include the provision of an adaptor sleeve to accommodate larger sized line on a fid of a given size, and a manner of accommodating lines of different sizes with a machine having interchangeable fids of different dimensions.

Thus, it is an object of the present invention to provide a line splicing machine having a fid able to be driven easily through a line, that fid also being able to grasp a line end permitting the end to be drawn back through the standing part.

It is a further object of the invention to provide a line splicing machine able to free both hands of the splicer, thereby permitting the splicer to work the line more efficiently while splicing, and to produce a better quality splice.

It is yet another object of the invention to provide a line splicing machine permitting a splicer to cut the time of making a splice to a small fraction of the time the same splice takes with conventional tools and methods.

An additional object of the invention is to provide a line splicing machine so simple, efficient and consistent in its operation as to permit a novice splicer to learn the art of making a quality splice in a fraction of the time it takes a novice to make that same quality splice with conventional tools and methods.

A still further object of the invention is to provide a line splicing machine which permits a splicer to splice used, old or worn line effectively.

And, an object of specific embodiments of the invention is to provide a line splicing machine able to accommodate lines of different diameters.

Still further objects of the inventive line splicing machine disclosed herein will be apparent from the drawings and following detailed description thereof.

BRIEF DESCRIPTION OF THE DRAWINGS

FIG. 5A is a side elevation showing the first step of a splicing operation wherein a simple eye is being fashioned in a length of braided line.

FIG. 5B is a side elevation showing the second step of the operation begun in FIG. 5A.

FIG. 5C is a side elevation showing the third step of the operation begun in FIG. 5A.

FIG. 5D is a side elevation showing the fourth step of the operation begun in FIG. 5A.

DESCRIPTION OF THE PREFERRED EMBODIMENTS

Figure 1:
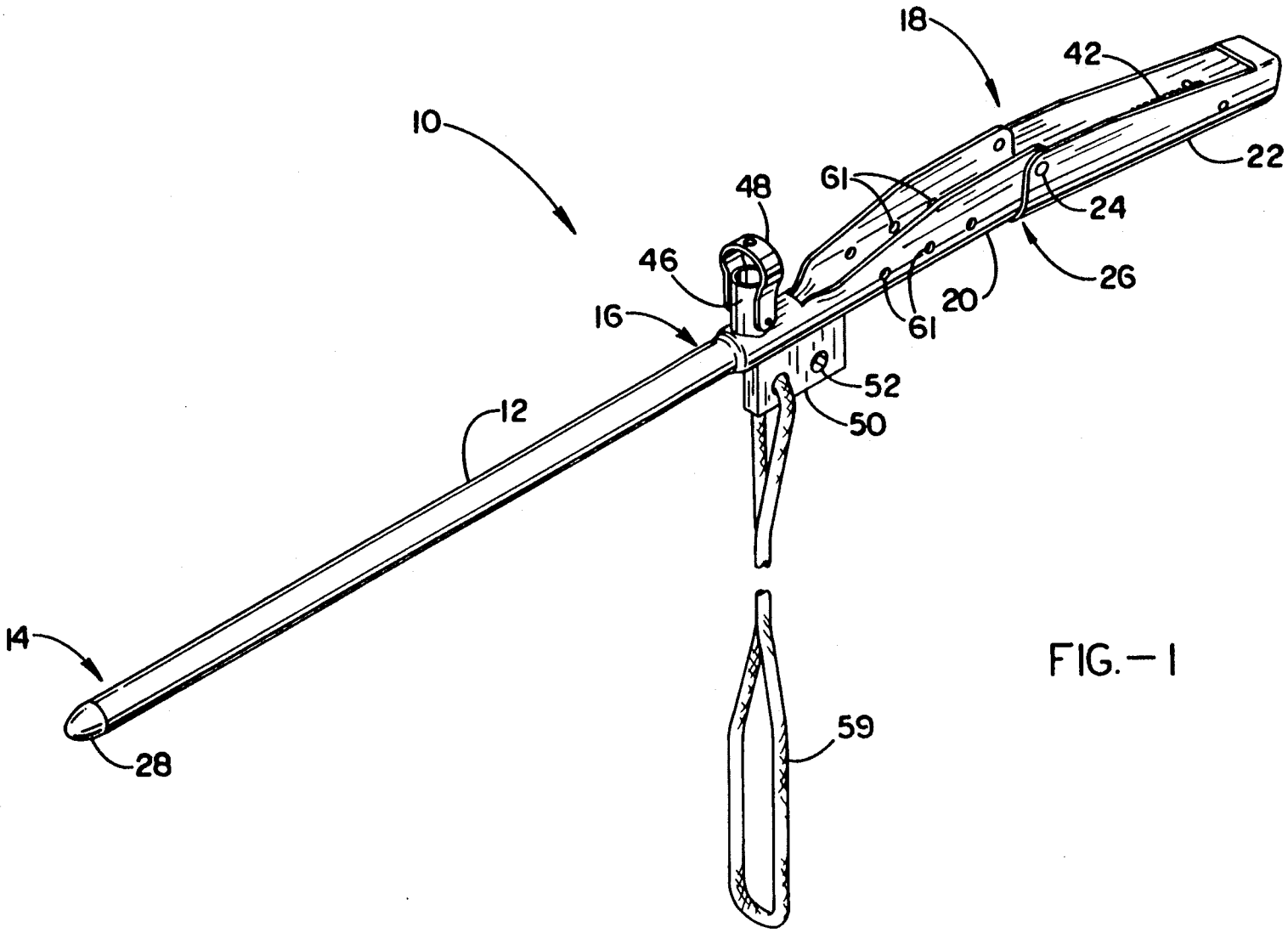
FIG. 1 is a perspective view of the splicing machine of the present invention, having its flop handle in the extended position and its tip biased against the forward end of its fid. 1.
Figure 2:
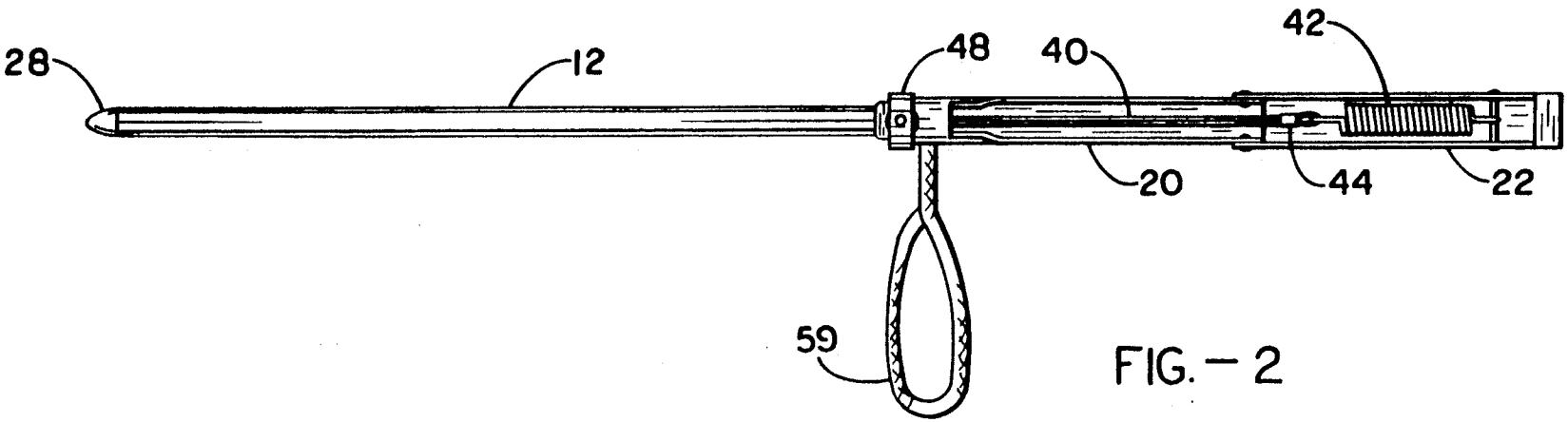
FIG. 2 is a top plan view of the splicing machine of FIG.
Figure 3:
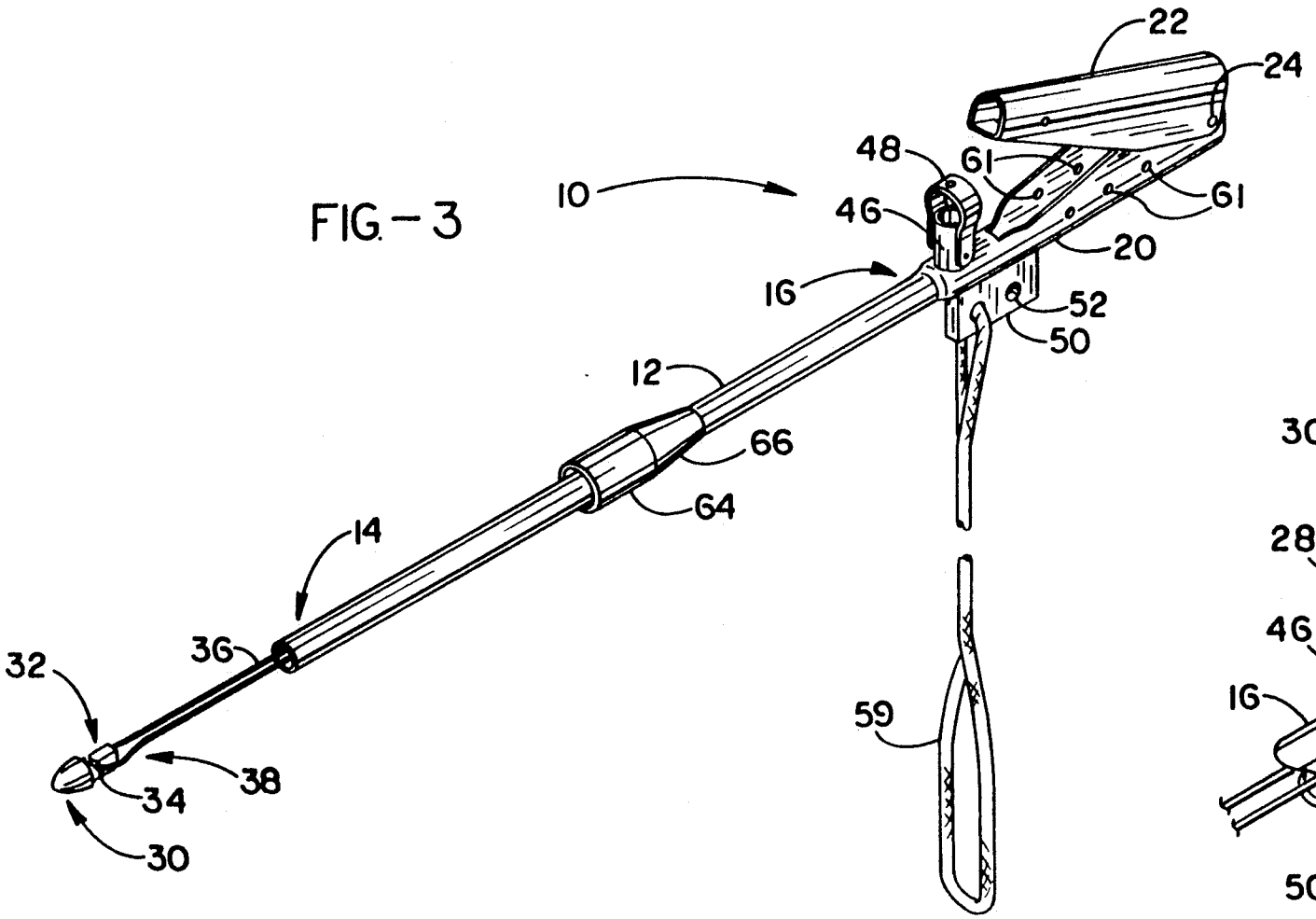
FIG. 3 is a perspective view of the splicing machine of FIG. 1, having its flop handle in the folded position, thus causing its wire snare to extend from the bore of its fid, and permitting its tip to be removed. Also shown, is an adaptor sleeve in its proper orientation on the fid.
Figure 3A:
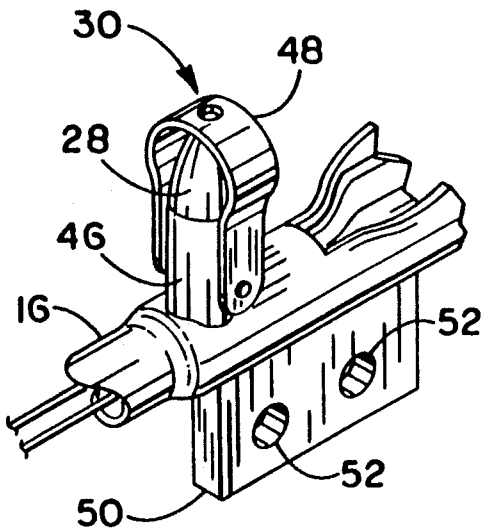
FIG. 3A is an enlarged perspective view of a tip receptacle mounted atop the rearward end of the fid of the machine of FIG. 1.

Referring now specifically to the drawings, FIGS. 1, 2 and 3 show a preferred embodiment of the inventive splicing machine, generally designated herein with reference numeral 10. Splicing machine 10 first includes an elongate, rigid, tubular fid 12. For working ropes ¾" or less in diameter, a fid 12 having an outside diameter of ⅜", and a length of 12" has been found to work well. Fid 12 is preferably constructed of steel, as are the majority of the rest of machine 10's elements. However, materials such as aluminum and other metals, and certain plastics as well, may also perform satisfactorily in practicing the invention.

Fid 12 has forward and rearward ends, these being designated in the drawings with reference numerals 14 and 16, respectively. Fid 12's rearward end 16 is affixed to a combination of elements generally referred to as the handle assembly and identified with reference numeral 18.

Handle assembly 18 first includes a first handle section identified herein as fixed handle 20 which is integrally bound in generally axial relation to fid 12. Fixed handle 20 is comprised of sheet metal bent to describe a U-shaped cross section; i.e. it is shaped as a trough. Handle 20 may be described as being the "frame" for this embodiment of the inventive machine. At fixed handle 20's rearward end, a pivoting arm, or second handle section, identified herein as flop handle 22 is pivotally mated thereto with pivot pins 24. Flop handle 22 is also fashioned of sheet metal bent into a U-shape. In the preferred embodiment, handle sections 20 and 22 are each roughly 4" long.

It should be particularly noted that the placement of pivot pins 24 between the handle sections is such that flop handle 22 hangs slightly below the horizontal, i.e. "over-center," when the machine is fully open and the fid is in the horizontal plane, as shown in FIG. 1. This is accomplished by making sure that the rearward end of fixed handle 20 and the forward end of flop handle 22 do not nest too closely together. That is, when both handle sections are oriented precisely horizontally, a slight gap should be evident at handle section mating point 26. This gap at point 26 is what permits flop handle 22 to drop over-center, a bit below the horizontal. Of course, when flop handle 22 is in its over-center position, no gap at mating point 26 is visible.

Fid 12's forward end 14 includes a tip 28 removably engaged therewith. As best seen in FIG. 2, tip 28 includes a bullet-shaped forward portion 30 and an axial shank 32 projecting to the rear. Shank 32 is shaped and dimensioned to nest within the bore of fid 12 at its forward end 14. Forward portion 30 of tip 28 has a diameter slightly greater than fid 12's bore, thus tip 28 only engages fid 12 to a depth equal to shank 32's length. Shank 32 includes a slot 34 generally transverse to shank 32's length and to a depth approximating half its diameter.

As seen in FIG. 3, opposing lengths of wire, forming wire snare 36, protrude from fid 12's forward end 14 and engage slot 34 of tip 28. Wire snare 36 is slidably disposed in the bore of fid 12 and is comprised of a single length of thin twisted steel cable doubled to form a loop 38 at fid 12's forward end 14. The termini 40 of wire snare 36 extend rearwardly through the open trough of fixed handle 20, somewhat beyond mating point 26, and are swaged to a terminal eye of a steel coil spring 42 with swage link 44. Spring 42 is bound to the rearward end of flop handle 22 with spring retaining pin 46 which transversely spans flop handle 22's trough and passes through spring 42's other terminal eye. Spring 42 preferably has enough length and resilience to permit its forward eye to pass forward of, and beyond, pivot pins 24 when the spring is extended.

Wire snare 36 and spring 42 are of such a combined length that when tip 28 is nested within the bore of the forward end of the fid, and when loop 38 engages slot 34 in shank 32, spring 42 assumes a slightly elongated posture while flop handle 22 is in the over-center position of FIG. 1. This causes tip 28 to be biased against the fid's forward end.

When flop handle 22 is thrown forward as in FIG. 2, tension on spring 42 is released, permitting tip 28 to be disengaged from loop 38. In this posture, loop 38 is greatly expanded.

To prevent loss of tip 28 once it is removed, an upright, cylindrical tip receptacle 46 is provided atop fid 12's rearward end 16. As shown in FIG. 2A, a tip retaining bail 48 fashioned of a resilient, pivoting loop of thin metal swings over receptacle 46 to hold tip 28 in place.

Figure 4:
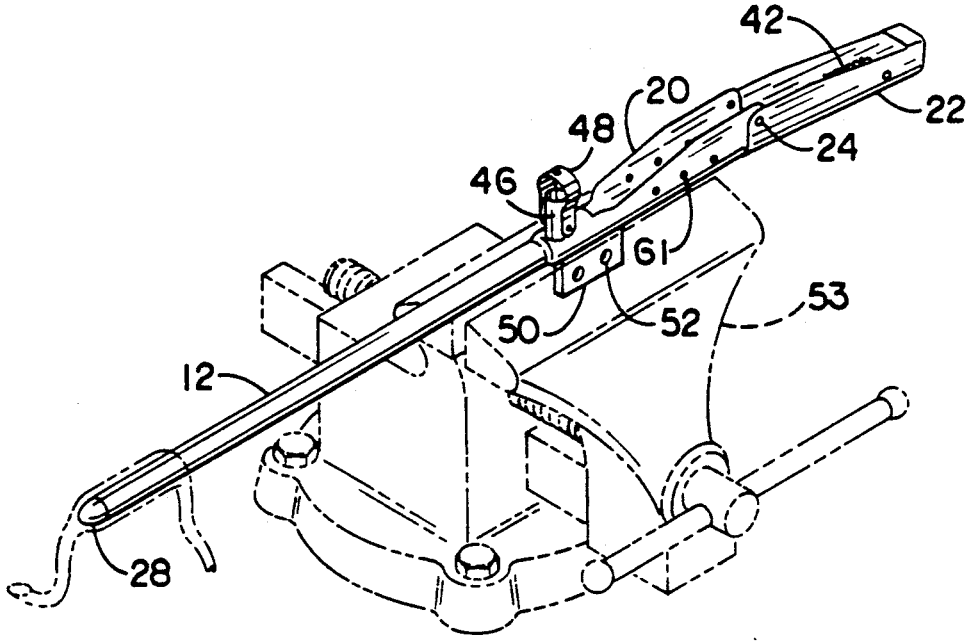
FIG. 4 is a perspective view of the splicing machine of FIG. 1 bound into a vice, and showing its fid driven axially into a length of braided line.

On the underside of machine 10, adjacent the rearward end 16 of fid 12, a mounting tab 50 is provided. Mounting tab 50 is integrally mated to machine 10 and is provided with a pair of apertures 52 to facilitate permanent mounting of the machine to a tripod or other sturdy support. In use, splicing machine 10 may be held in one's hand, mounted as suggested above, or bound into a vice 53 as shown in FIG. 4.

Use of splicing machine 10 will be illustrated in performing a splice to form a simple eye in a length of braided line 54. At the outset, it is preferred that the line's end be trimmed diagonally, as shown. The machine's beginning orientation should be as shown in FIGS. 1 and 2, having its flop handle 22 in an over-center position, thereby extending spring 42 to bias tip 28 into fid 12's forward end 14. As in FIG. 5A, fid 12 is driven into the standing part 56 of the line a short distance from the line's end 58. Fid 12 is guided axially through the lumen of the line toward end 58. Tip 28 is then caused to emerge from the line a bit closer to line end 58, but still in the line's standing part.

Then, as shown in FIG. 5B, loop 38 is caused to protrude from the fid's forward end, permitting tip 28 to be removed. As explained above, this is accomplished by throwing flop handle 22 forward. Line end 58 is then reeved into loop 38, in position to be grasped thereby. At this point, it is also advantageous to draw a single yarn 60 from the line for a purpose that will be explained below.

Next, as in FIG. 5C, line end 58 is drawn into the fid's forward end by loop 38. Of course, this is accomplished by returning the flop handle to the over-center position in which it is shown in FIGS. 1 and 2.

Once the line end is bound securely into the fid's forward end, the line end is drawn back through the lumen of the line, as shown in FIG. 5D, the lumen having originally been held open by the fid. This action may be aided by placing one's foot in the loop of lanyard 59, shown in FIG. 3, and pulling the standing part 58 of the line off the fid. The line end is preferably released at the point within the standing part where the fid made its original entry. Release is accomplished by simply throwing the flop handle forward. The splice is tightened by tugging on the eye of the loop adjacent the original standing part, this causing the standing part to constrict on the line end. This principle is akin to that observed in operation of the novelty item known as a "chinese handcuff" wherein fingers inserted into opposing ends of a braided tube are difficult to withdraw.

If the splicer is working with old, used line, or line otherwise likely to bind on itself when having its end pulled through its lumen, there is some likelihood that loop 38 will tend to be pulled further out of the fid, against the tension of spring 42. If this occurs, there is some possibility of over-extending the spring and thereby damaging it. Thus, a series of apertures 61 are provided in fixed handle 20 just forward of pivot pins 24 to permit a crosspiece such as an awl, a nail, or the like (not shown) to be slipped therethrough, and simultaneously through spring 42's forward eye. Thus, the load of such pulling action against the spring may be transferred to the crosspiece, thereby protecting the spring.

Figure 6:
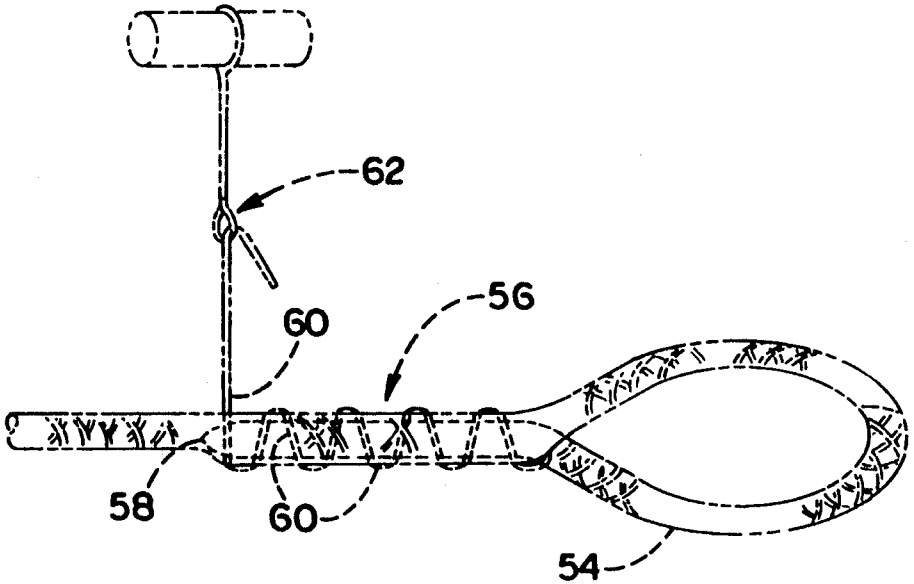
FIG. 6 is a side elevation showing a yarn, in phantom line, extending from the throat of the eye fashioned by the steps illustrated in FIGS. 5A–D, being used to secure the splice by sewing it through the splice with a latch hook.

Once the splice is complete, it is preferred that loose yarn 60 be sewed through the splice to strengthen it, as in FIG. 6. This can be conveniently accomplished with a tool generally known as a latch hook 62, the operation of which is evident from FIG. 6. This step may also be carried out while line end 58 is still bound into the fid's forward end, i.e. at the stage in the splicing operation shown in FIG. 5D. And, the line end may also be given a final tapered trim at this point to assure that it will lay properly within the line's standing part 56 once the splice is complete. Then, as the splice is smoothed or "milked" by hand, line end 58 becomes buried within standing part 56. One of the benefits of this approach is that if machine 10 is mounted on a tripod or other sturdy support, both the splicer's hands may be used in the sewing and end trimming operations.

Figure 7A:
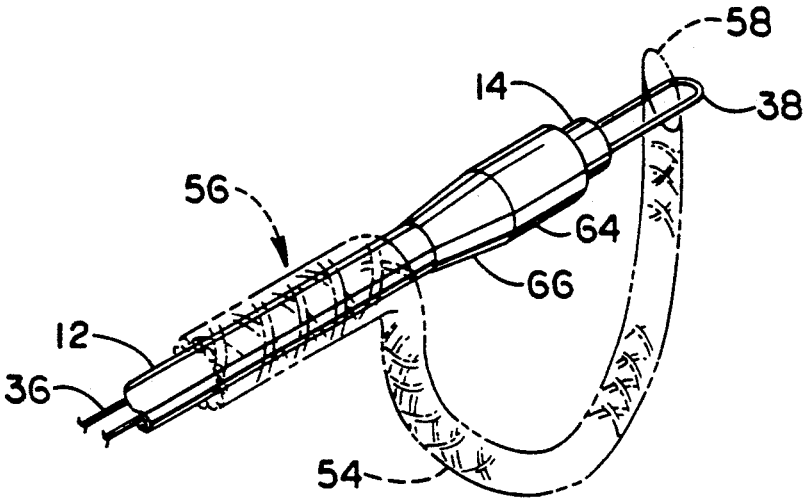
FIG. 7A is a perspective view of an adaptor sleeve in position for use on the fid of a splicing machine.
Figure 7B:
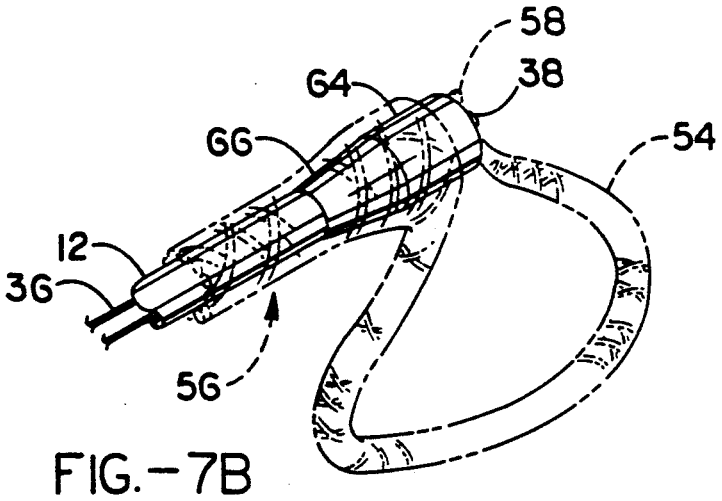
FIG. 7B is a perspective view of the adaptor sleeve of FIG. 7A showing a line end being drawn into the adaptor by the machine's wire snare, and showing the tapered portion of the adaptor forcing open a channel in the line's standing part.

As shown in FIGS. 7A and 7B, larger lines can be accommodated on a smaller fid by addition of an adaptor sleeve 64. Sleeve 64 has an inside diameter slightly greater than the outside diameter of the fid, one end being tapered to a conical shape between its inside and outside diameters and the other being machined out to form a somewhat concave cavity. Sleeve 64's outside diameter can be as large as needed to expand the size rope being spliced. In use, the fid is first passed axially through the standing part of the line and cause to emerge adjacent, but somewhat away from, the line end. As loop 38 is tightened to grasp the large line end, it is tucked into the bore of the adaptor, presenting a fairly smooth outer surface between the adaptor and the line. And, as the fid is pulled, along with the line end, into the lumen of the standing part of the line, the tapered portion 66 of the adaptor aids in stretching the lumen to accommodate the large line end, as best shown in FIG. 7B.

Figure 8:
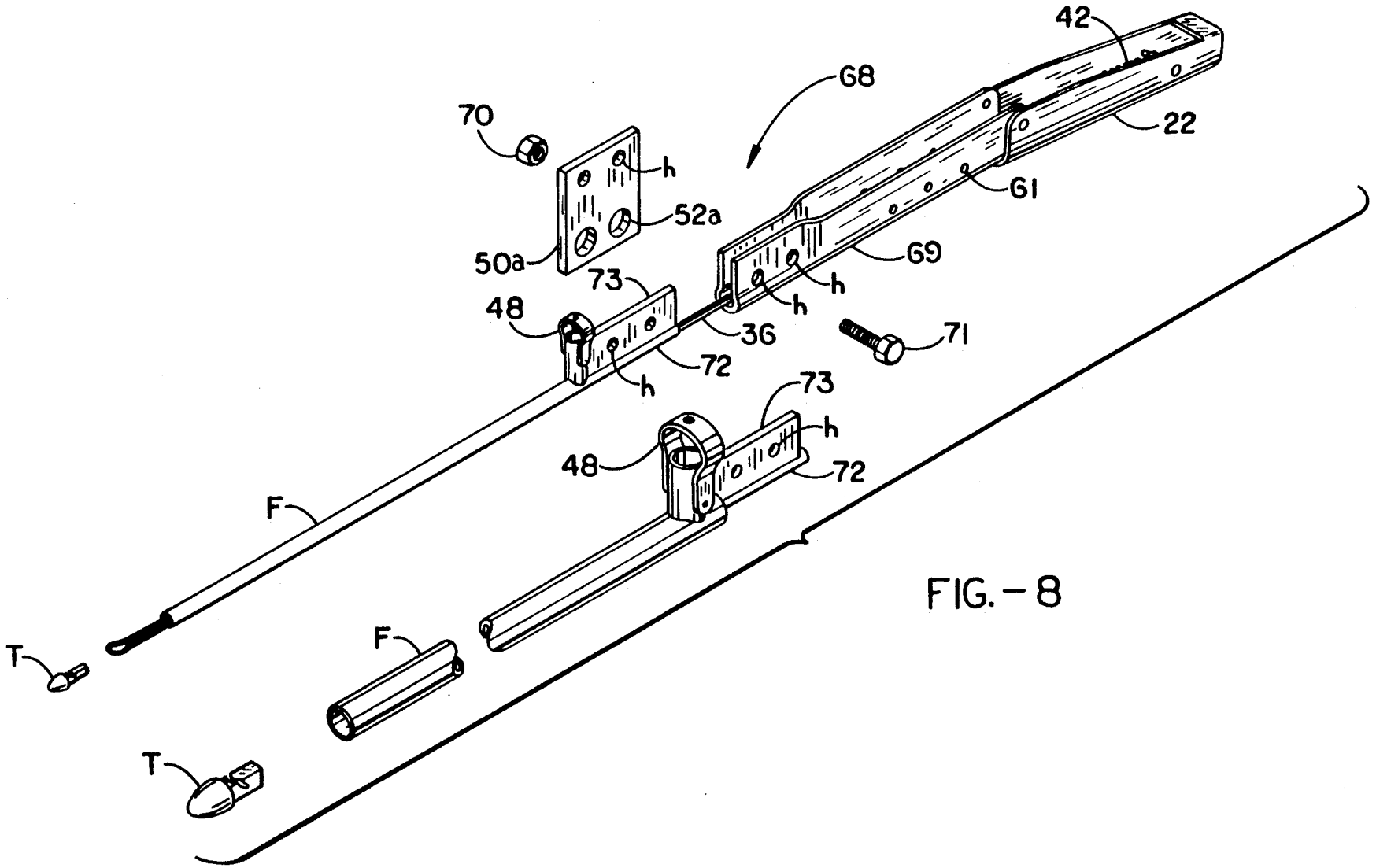
FIG. 8 is an exploded perspective view showing an alternative embodiment of the splicing machine of the invention, this embodiment having interchangeable fids of different diameters for working lines of different diameter.

As it may also be desirable to have a splicing machine with interchangeable fids of different sizes, such an alternative embodiment 68 of the machine is shown in FIG. 8. Therein, fixed handle 69 is shown to be fashioned as a clamp and is able to be constricted by one or more nuts 70 and bolts 71 which pass through holes h in handle 69, key 73 and mounting tab 50*a*. As shown, fids F of several diameters may be accommodated thereby, as long as each has a standard sized butt 72 and a key 73. The same wire snare 36 should accommodate different fids F, but different sized tips T would be required. Tab 50*a*, fastened to fixed handle 69, facilitates mounting embodiment 68 of the machine in a vice 53, or the like.

Figure 9:
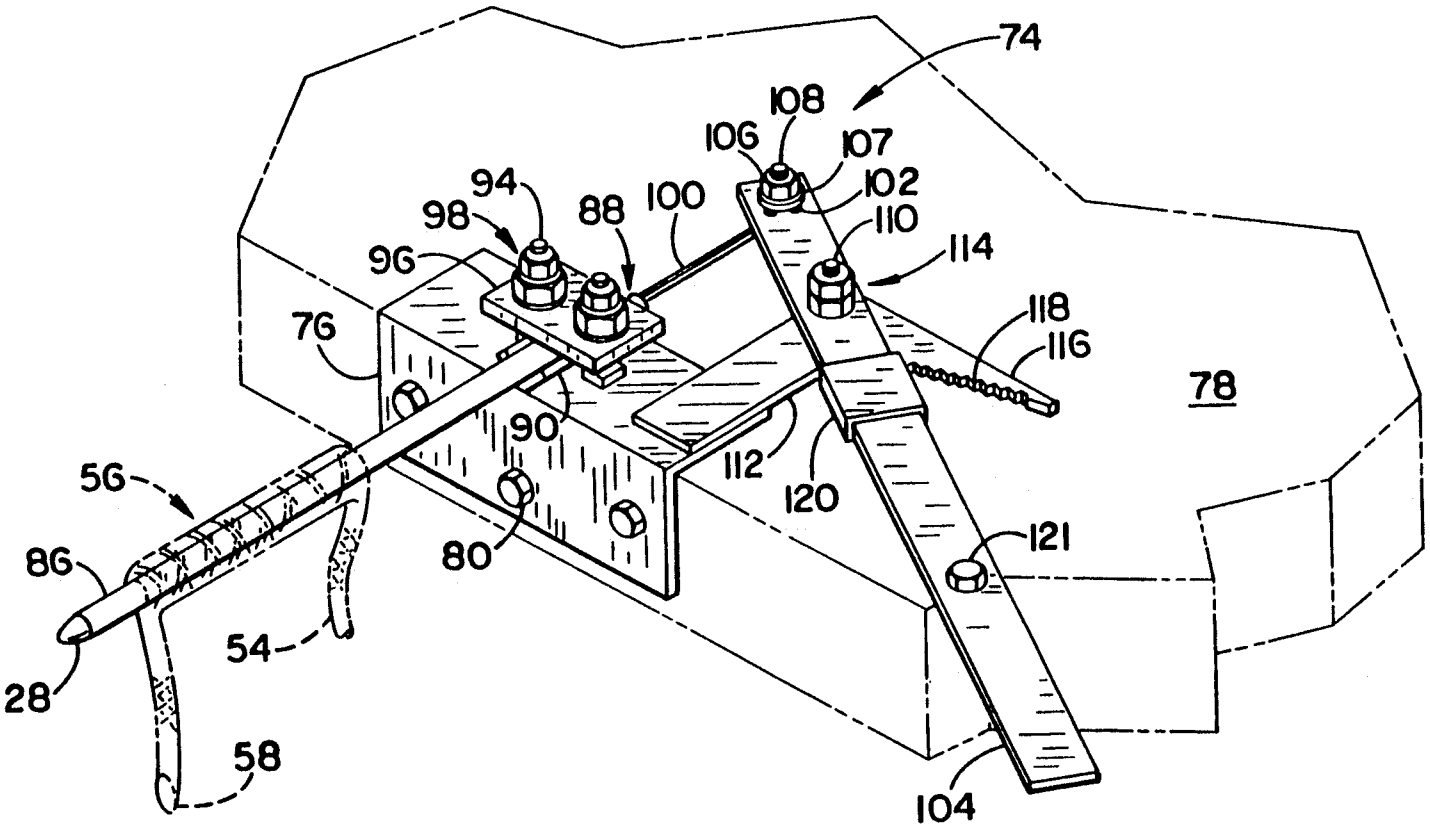
FIG. 9 is a perspective view of an alternative bench-mounted embodiment of the splicing machine.
Figure 10:
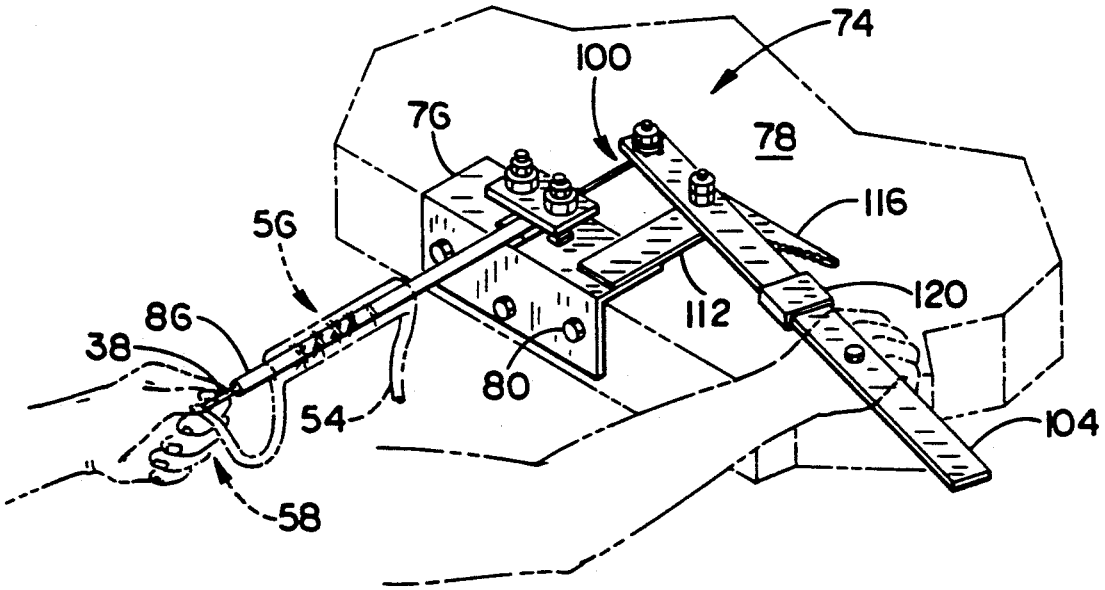
FIG. 10 is a perspective view of the embodiment of FIG. 9, showing its use.

A bench-mounted embodiment of the inventive splicing machine is also envisioned, this being disclosed in FIGS. 9 and 10, and being identified with reference numeral 74. Bench-mounted embodiment 74 is built upon a length of angle stock 76 which is bolted to bench 78 with bolts 80. Stock length 76 may be described as a frame for this embodiment of the invention. A fid 86 extends horizontally from angle stock 76, and perpendicularly from the edge of bench 78. Fid 86's butt 88 is slidingly nested in a short, horizontally-oriented length of angle stock 90, welded along its outer apex to angle stock length 76 such that its inner angle opens upward. Studs 94, the threaded ends of which can be seen in FIGS. 9 and 10, cooperate with plate 96, biased by nuts 98 against fid butt 88, to secure butt 88 into stock length 90. As can be seen, horizontal stock length 90, studs 94, plate 96 and nuts 98 permit fid 86 to be exchanged with fids of different sizes at will.

Fid 86 is constructed as in proceeding embodiments, having a tip 28 at its forward end, this tip having a slot (not shown) in its shank for receipt of the loop 38 of wire snare 100 within fid 86.

The termini 102 of snare 100 are bound to an outward-extending, pivoting, locking arm 104 by nut 106 and washer 107 on bolt 108 where termini 102 pass through locking arm 104. Thus, the length of wire snare 100 is adjustable. Locking arm 104 is fashioned of strap iron and pivots on bolt 110 which passes through right-angled fulcrum extension 112, bolt 110 being secured with nuts 114. Fulcrum extension 112 is welded to stock length 76 and extends horizontally inward from bench 78's edge. Fulcrum extension 112 has a right-angled, toothed protrusion 116 away from the axis of fid 86, toothed protrusion 116 being tapered and having teeth 118 formed in its edge.

Sliding collar 120 is slidingly mounted on locking arm 104. Collar 120 can be caused to settle securely against one or another tooth 118, thereby inhibiting the pivoting motion of locking arm 104 if either a tip 28 or a rope end 58 are bound into the loop 38 of the snare 100 causing tension against locking arm 104. Thus, collar 120 holds arm 104 in a position that exerts a constant pulling force against loop 38.

In use, a splicer simply draws locking arm 104 in a proximal direction, thereby tensioning wire snare 100 and holding tip 28 in fid 86's end. Collar 120 is slid along arm 104 until it settles against a tooth 118 as in FIG. 9. Collar 120 remains wedged between toothed protrusion 116 and arm 104 maintaining tension on wire snare 100. Any line being worked may then be slipped onto fid 86, as necessary, as shown in FIG. 9. Next, collar 120 is slid back and away from the teeth of protrusion 116, arm 104 is swung away from the splicer, and tip 28 is removed. Stop 121 keeps collar 120 from sliding off arm 104. Line end 58 is slipped into loop 38 and, as in FIG. 10, arm 104 is drawn toward the splicer until end 58 is bound securely into fid 86's end. Arm 104 is then locked in place with collar 120. Splicing is carried out as explained above in the context of hand-held embodiment 10.

Embodiment 74 is particularly useful in the industrial environment because it frees both hands while working, thereby promoting productivity. However, in mounting embodiment 74 upon a bench top in a space-limited environment where projecting fid 86 may obstruct the path of passing personnel, it has been found expedient to mount the embodiment on a block on the bench top a distance inward from the bench's edge approximating the length of fid 86. This permits the splicer to belly up to the bench to work while keeping the fid from projecting into a thoroughfare during nonuse.

Of course, one skilled in the art will envision many other mechanisms for biasing a tip or line end against the end of a fid. A more rigid extension could be substituted for a wire snare, and many known combinations of pins, levers, cranks, pulleys, springs, ratchets and the like, as well as gravity, can be envisioned as being effective for pulling on a wire or other extension from a fid's butt end. And, a clip, plug or chock in a fid's end may also serve to hold a line end therein. Further, a solid fid having a longitudinal slot or channel therein could be employed, although a tubular fid is felt to be superior. Thus, the foregoing detailed disclosure of the inventive splicing machine is considered as only illustrative of the preferred embodiments of, and not a limitation upon the scope of, the invention. Those skilled in the art will envision many other possible variations of the structure disclosed herein that nevertheless fall within the scope of the following claims. And, alternative uses for this inventive machine may later be realized. Accordingly, the scope of the invention should be determined with reference to the appended claims, and not by the examples which have herein been given.

I claim:

1. A line splicing machine comprising:

a. an elongate fid having a forward end and a rearward end;

b. a removable tip at said fid's forward end; and, c. means for biasing a line end against said fid's forward end wherein said biasing means includes a pivoting arm having a collar slidingly disposed thereon, and wherein said collar may be caused to settle against a toothed protrusion to inhibit said arm's motion.

2. The machine of claim 1, wherein said fid is tubular.

3. The machine of claim 1, wherein said biasing means is also operable to bias said tip against said fid's forward end.

4. The machine of claim 1, wherein said biasing means is operable from said fid's rearward end.

5. The machine of claim 1, wherein said pivoting arm is a spring-biased flop handle.

6. The machine of claim 1 wherein said biasing means includes a wire snare slidingly disposed within said fid.

7. The machine of claim 1 wherein said tip includes a slot for receipt of a wire snare.

8. The machine of claim 1, further including a generally cylindrical adaptor sleeve having an inside diameter slightly greater than said fid's outside diameter, said adaptor also having a conical end and a concave opposing end.

9. The machine of claim 1, wherein said fid is removable and wherein said fid is replaceable with a fid of a different size.

10. A line splicing machine comprising:

a. an elongate fid having a forward end and a rearward end;

b. a removable tip at said fid's forward end;

c. means for biasing a line end against said fid's forward end; and, d. a generally cylindrical adaptor sleeve having an inside diameter slightly greater than said fid's outside diameter, said adaptor also having a conical end and a concave opposing end.

11. The machine of claim 10, wherein said fid is tubular.

12. The machine of claim 10, wherein said biasing means is also operable to bias said tip against said fid's forward end.

13. The machine of claim 10, wherein said biasing means is operable from said fid's rearward end.

14. The machine of claim 10, wherein said biasing means includes a pivoting arm.

15. The machine of claim 14, wherein said pivoting arm is a spring-biased flop handle.

16. The machine of claim 14, wherein said pivoting arm has a collar slidingly disposed thereon, and wherein said collar may be caused to settle against a toothed protrusion to inhibit said arm's motion.

17. The machine of claim 10 wherein said biasing means includes a wire snare slidingly disposed within said fid.

18. The machine of claim 10 wherein said tip includes a slot for receipt of a wire snare.

19. The machine of claim 10, wherein said fid is removable and wherein said fid is replaceable with a fid of a different size.

20. A line splicing machine comprising:

a. a frame;

b. an elongate tubular fid projecting from said frame, said fid having a forward end and a rearward end;

c. a removable tip at said fid's forward end; and, d. means for biasing a line end against said fid's forward end including a pivoting arm mounted on said frame and operable from said fid's rearward end wherein said pivoting arm has a collar slidingly disposed thereon, and wherein said collar may be caused to settle against a toothed protrusion to inhibit said arm's motion.

21. The machine of claim 20, wherein said biasing means is also operable to bias said tip against said fid's forward end.

22. The machine of claim 20, wherein said pivoting arm is a spring-biased flop handle.

23. The machine of claim 20 wherein said biasing means includes a wire snare slidingly disposed within said fid.

24. The machine of claim 20 wherein said tip includes a slot for receipt of a wire snare.

25. The machine of claim 20, further including a generally cylindrical adaptor sleeve having an inside diameter slightly greater than said fid's outside diameter, said adaptor also having a conical end and a concave opposing end.

26. The machine of claim 20, wherein said fid is removable and wherein said fid is replaceable with a fid of a different size.

27. A line splicing machine comprising:

a. a frame;

b. an elongate tubular fid projecting from said frame, said fid having a forward end and a rearward end;

c. a removable tip at said fid's forward end;

d. means for biasing a line end against said fid's forward end; and, e. a generally cylindrical adaptor sleeve having an inside diameter slightly greater than said fid's outside diameter, said adaptor also having a conical end and a concave opposing end.

28. The machine of claim 27, wherein said biasing means is also operable to bias said tip against said fid's forward end.

29. The machine of claim 27, wherein said biasing means includes a pivoting arm mounted on said frame and operable from said fid's rearward end.

30. The machine of claim 29, wherein said pivoting arm is a spring-biased flop handle.

31. The machine of claim 29, wherein said pivoting arm has a collar slidingly disposed thereon, and wherein said collar may be caused to settle against a toothed protrusion to inhibit said arm's motion.

32. The machine of claim 27 wherein said biasing means includes a wire snare slidingly disposed within said fid.

33. The machine of claim 27 wherein said tip includes a slot for receipt of a wire snare.

34. The machine of claim 27, wherein said fid is removable and wherein said fid is replaceable with a fid of a different size.

35. A line splicing machine comprising:

a. a frame;

b. an elongate tubular fid projecting from said frame and removably affixed thereto, said fid having a forward end and a rearward end;

c. a removable tip at said fid's forward end;

d. means operable from said fid's rearward end for biasing said tip and, alternatively, a line end against said fid's forward end; and, e. a generally cylindrical adaptor sleeve having an inside diameter slightly greater than said fid's outside diameter, said adaptor also having a conical end and a concave opposing end.

36. The machine of claim 35 wherein said biasing means includes a wire snare slidingly disposed within said fid.

37. The machine of claim 35 wherein said tip includes a slot for receipt of a wire snare.

* * * * *